US008986051B2

(12) United States Patent
Tu et al.

(10) Patent No.: US 8,986,051 B2
(45) Date of Patent: Mar. 24, 2015

(54) SOCKET CONNECTOR, PLUG CONNECTOR, CONNECTOR ASSEMBLY, AND HANDHELD ELECTRONIC DEVICE

(75) Inventors: Chih-Wei Tu, Taoyuan County (TW); Ta-Wei Liu, Taoyuan County (TW); I-Cheng Chuang, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 223 days.

(21) Appl. No.: 13/316,573

(22) Filed: Dec. 12, 2011

(65) Prior Publication Data

US 2013/0149914 A1 Jun. 13, 2013

(51) Int. Cl.
*H01R 24/28* (2011.01)

(52) U.S. Cl.
USPC ..... 439/686

(58) Field of Classification Search
CPC ..... H01R 24/58; H01R 23/02; H01R 13/658; H01R 13/26
USPC ..... 439/66, 692, 668
See application file for complete search history.

(56) References Cited

U.S. PATENT DOCUMENTS

| | | | | |
|---|---|---|---|---|
| 6,648,695 | B1 * | 11/2003 | Wu | 439/638 |
| 7,572,146 | B1 | 8/2009 | Chiang | |
| 8,007,289 | B2 * | 8/2011 | Bandhu et al. | 439/79 |
| 8,011,959 | B1 * | 9/2011 | Tsai et al. | 439/607.25 |
| 8,033,869 | B1 * | 10/2011 | Zhu et al. | 439/660 |
| 8,052,479 | B1 * | 11/2011 | Zhu | 439/660 |
| 2004/0023559 | A1 * | 2/2004 | Wu | 439/638 |
| 2008/0261448 | A1 | 10/2008 | Yi et al. | |
| 2010/0167568 | A1 | 7/2010 | Kondo | |
| 2010/0173530 | A1 * | 7/2010 | Tsai | 439/660 |
| 2010/0317229 | A1 * | 12/2010 | Chen et al. | 439/607.23 |
| 2011/0070778 | A1 * | 3/2011 | Wan et al. | 439/660 |
| 2011/0130019 | A1 * | 6/2011 | Lim et al. | 439/218 |
| 2011/0195601 | A1 * | 8/2011 | Chen et al. | 439/607.01 |
| 2011/0263162 | A1 | 10/2011 | Zhu | |
| 2011/0294362 | A1 * | 12/2011 | Lim et al. | 439/692 |
| 2012/0077385 | A1 * | 3/2012 | Qiao | 439/628 |

FOREIGN PATENT DOCUMENTS

| | | |
|---|---|---|
| CN | 2831473 | 10/2006 |
| CN | 201754447 | 3/2011 |
| CN | 201887293 | 6/2011 |
| CN | 201966365 | 9/2011 |
| EP | 1990868 | 11/2008 |
| EP | 2202850 | 6/2010 |
| TW | M396495 | 1/2011 |
| TW | M411707 | 9/2011 |

OTHER PUBLICATIONS

"Office Action of Taiwan counterpart application", issued on Oct. 29, 2013, p. 1-p. 10, in which the listed references were cited.
"Search Report of Europe Counterpart Application", issued on Jul. 8, 2013, p. 1-p. 7, in which the listed references were cited.
"Office Action of China Counterpart Application", issued on Sep. 23, 2014, p. 1-p. 8, in which the listed references were cited.
"Office Action of European Counterpart Application", issued on Jan. 15, 2014, p. 1-p. 6, in which the listed reference was cited.
"Office Action of China Counterpart Application", issued on Jan. 20, 2015, p1-p8, in which the listed reference was cited.

* cited by examiner

*Primary Examiner* — Briggitte R Hammond
(74) *Attorney, Agent, or Firm* — Jianq Chyun IP Offfice

(57) ABSTRACT

A socket connector having high current carrying capacity is provided by enlarging cross-section of particular terminals, to meet requirement such as transmitting large current or quick charge. Furthermore, a plug connector coupled with the socket connector, a connector assembly including the socket connector and the plug connector, and a handheld electronic device applying the socket connector are provided.

15 Claims, 11 Drawing Sheets

SOCKET CONNECTOR, PLUG CONNECTOR, CONNECTOR ASSEMBLY, AND HANDHELD ELECTRONIC DEVICE

BACKGROUND OF THE INVENTION

1. Field of the Invention

The present application relates to a connector, and more particularly, to an universal connector compatible with multiple connecting interfaces.

2. Description of Related Art

Conventional external devices such as earphones or speakers are provided with different connectors to transmit data. Connecting interfaces of common connectors includes High-Definition Multimedia Interface (HDMI), audio interface, universal serial bus (USB) interface, charging interface, and so on. For the design trend of being light, slim, short, and compact, handheld electronic devices such as cell phones, personal digital assistants (PDAs) or smart phones are provided with multiple connectors indifferent specifications to connect different external devices. However, the above requirement not only raises manufacturing cost, but increases volume and weight of handheld electronic devices.

Accordingly, designs for integrating plural connecting interfaces into one connector are proposed to meet the above requirement. Nonetheless, existing conventional universal connectors are still excluded from some applications such as transmitting large current or quick charge. In addition, an area of a tongue of the conventional universal connector is unavoidably increased for carrying a large number of terminals, which reduces structural strength of the tongue, while the tongue is likely to be damaged by external impact or in a long time use.

SUMMARY OF THE INVENTION

The present application provides a socket connector having high current carrying capacity by enlarging cross-section of particular terminals, to meet requirements of transmitting large current or quick charge.

The socket connector suitable for being connected to a plug connector comprises a base, a first tongue, plural first terminals and plural second terminals. The base has a slot, and the plug connector is suitable for being assembled to the base through the slot. The first tongue is connected to the base and located in the slot, and the first tongue has a first surface and a second surface opposite to the first surface. The first and second terminals pass through the base, wherein each of the first terminals and each of the second terminals respectively have a first contact portion and a second contact portion both mounted on the first surface of the first tongue. And, a cross-section of each of the second terminals is greater than a cross-section of each of the first terminals.

A handheld electronic device adopting the aforementioned socket connector is also provided, wherein a plug connector can be connected to a main body of the handheld electronic device through the socket connector. Since the socket connector has high current carrying capacity, diverse applications, such as integrating multifunctional interfaces of video-audio transmission, data transmission and quick charge, can be accomplished.

A plug connector for being connected to the socket connector mentioned above is also provided in the present application. The plug connector includes plural first leads and plural second leads. The first leads are disposed in corresponding to the first terminals and adapted to be contact with the corresponding first terminals when the plug connector is connected to the socket connector. The second leads are disposed in corresponding to the second terminals and adapted to be contact with the corresponding second terminals when the plug connector is connected to the socket connector, wherein each of the second terminals is contact with at least two of the second leads.

The present application further provides a connector assembly including a socket connector and a plug connector matched with each other. The socket connector includes a base, a first tongue, plural first terminals and plural second terminals. The base has a slot. The first tongue is connected to the base and located in the slot, and the first tongue has a first surface and a second surface opposite to the first surface. The first and second terminals pass through the base, wherein each of the first terminals and each of the second terminals respectively have a first contact portion and a second contact portion both mounted on the first surface of the first tongue. And, a cross-section of each of the second terminals is greater than a cross-section of each of the first terminals. The plug connector is suitable for being connected to the socket connector and being assembled to the base through the slot. The plug connector includes plural first leads and plural second leads. The first leads are disposed in corresponding to the first terminals and adapted to be contact with the corresponding first terminals when the plug connector is connected to the socket connector. The second leads are disposed in corresponding to the second terminals and adapted to be contact with the corresponding second terminals when the plug connector is connected to the socket connector, wherein each of the second terminals is contact with at least two of the second leads to provide high current carrying capacity.

The present application can further be provided with enforcing members disposed on the first tongue of the socket connector, particularly to fragile portions of the first tongue, to enhance structural strength of the first tongue and prevent the first tongue from being damaged by external impact or in a long time use. Therefore, reliability and lifetime of the socket connector can be increased.

In order to make the aforementioned features and advantages of the application more comprehensible, embodiments accompanying figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DETAILED DESCRIPTION OF DISCLOSED EMBODIMENTS

Figure 1:
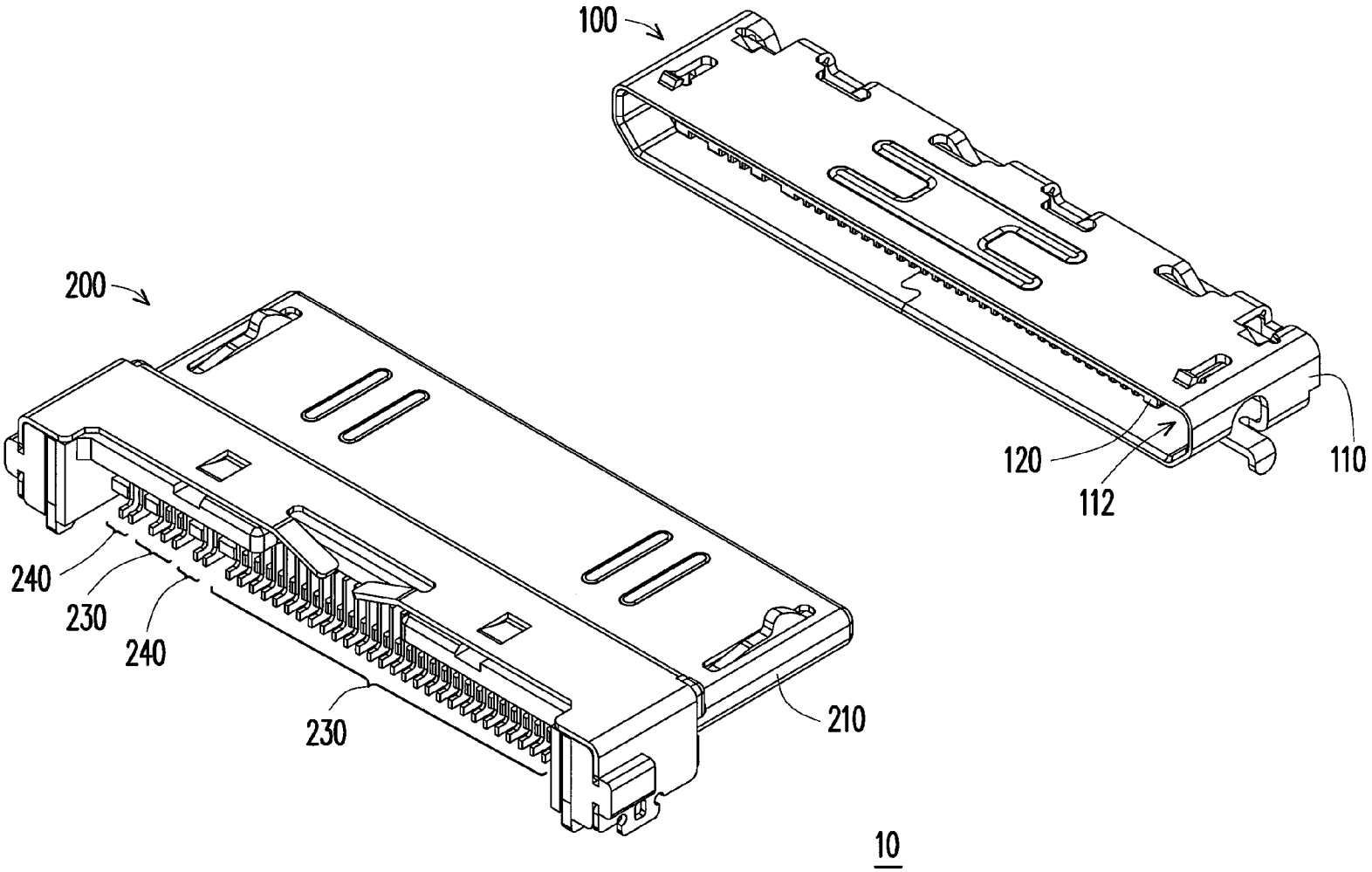
FIG. 1 is an exploded view of a connector assembly according to an embodiment of the present application.

FIG. 1 is an exploded view of a connector assembly according to an embodiment of the present application. The connector assembly 10 of the present embodiment includes a socket connector 100 and a plug connector 200 matched with each other. The socket connector 100 includes a base 110, a first tongue 120, plural first terminals 130 and plural second terminals 140. The base 110 has a slot 112 for receiving the plug connector 200. The first tongue 120 is connected to the base 110 and located in the slot 112.

Figure 2A:
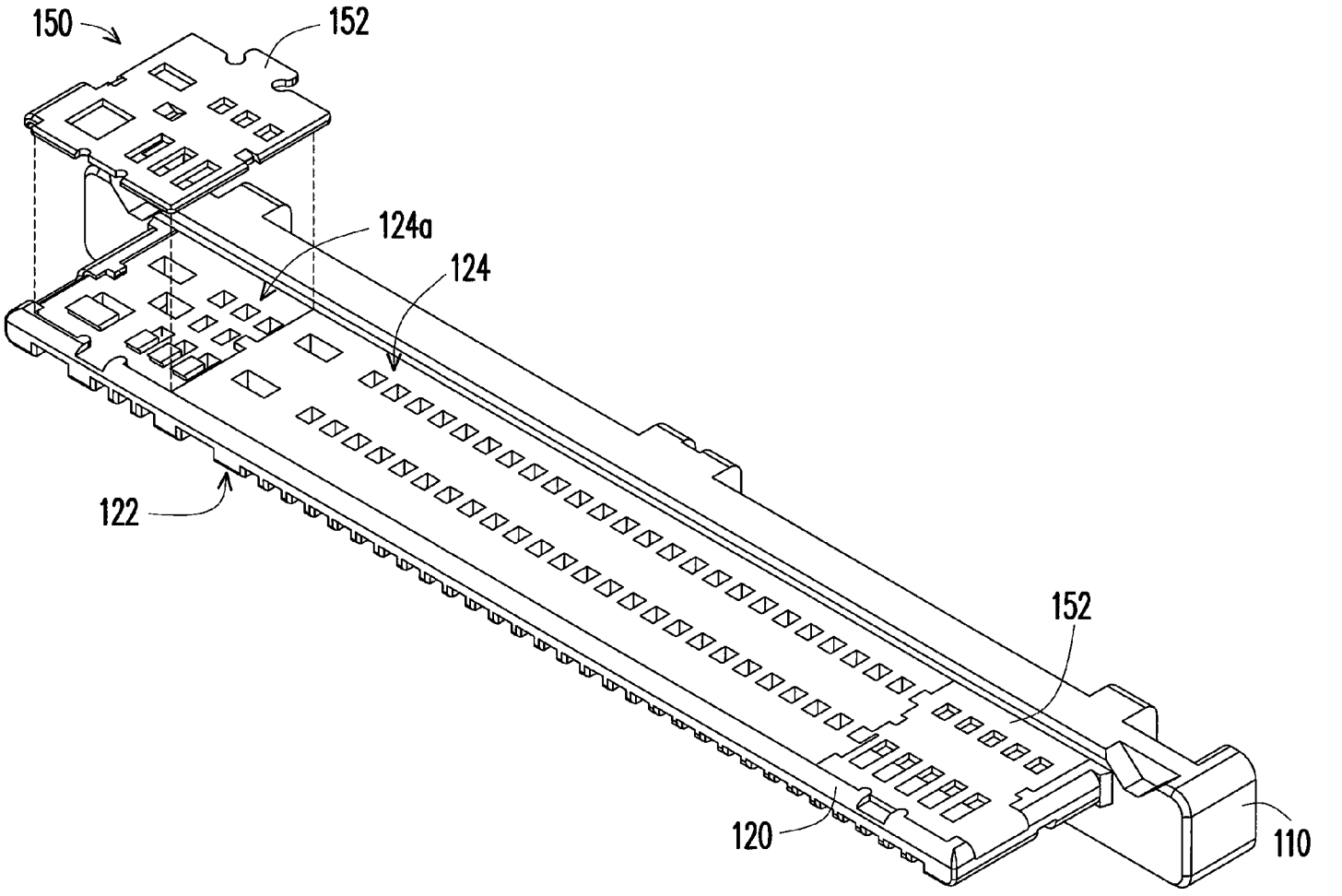
FIG. 2A and FIG. 2B are schematic drawings showing a partial structure of the socket connector of FIG. 1 in different view angles.
Figure 2B:
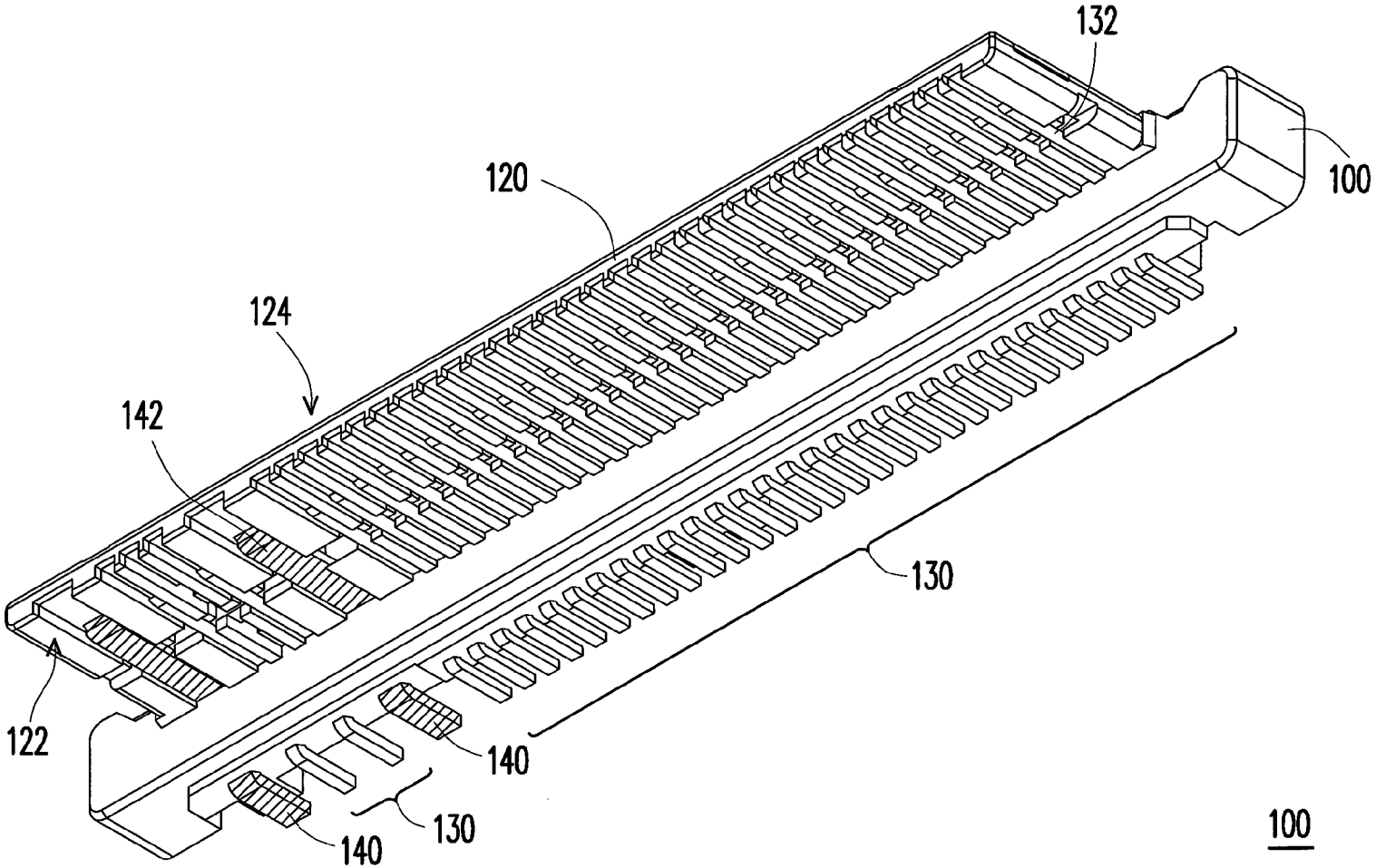

FIG. 2A and FIG. 2B are schematic drawings showing a partial structure of the socket connector 100 of FIG. 1 in different view angles. Referring to FIGS. 1, 2A and 2B, the first tongue 120 has a first surface 122 and a second surface 124 opposite to the first surface 122. The first terminals 130 and the second terminals 140 pass through the base 110, wherein each of the first terminals 130 and each of the second terminals 140 respectively have a first contact portion 132 and a second contact portion 142 both mounted on the first surface 122 of the first tongue 120. Additionally, a cross-section of each of the second terminals 140 is greater than a cross-section of each of the first terminals 130. In other words, the socket connector 100 of the present embodiment is provided with second terminals 140 having large cross-sections to meet the requirements of transmitting large current or quick charge.

Figure 3A:
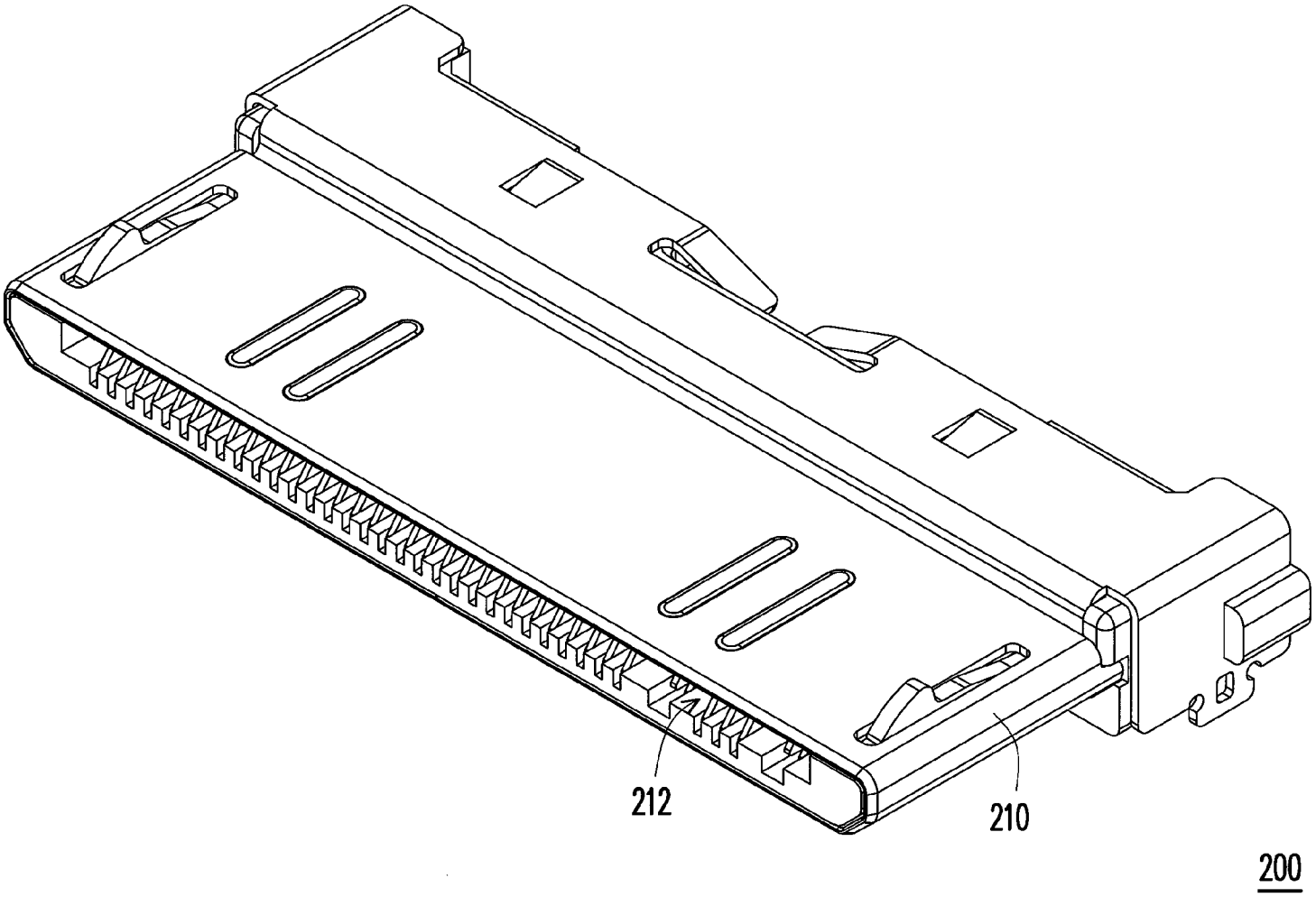
FIG. 3A and FIG. 3B are schematic drawings respectively showing a whole structure and a partial structure of the plug connector of FIG. 1 in another view angle.
Figure 3B:
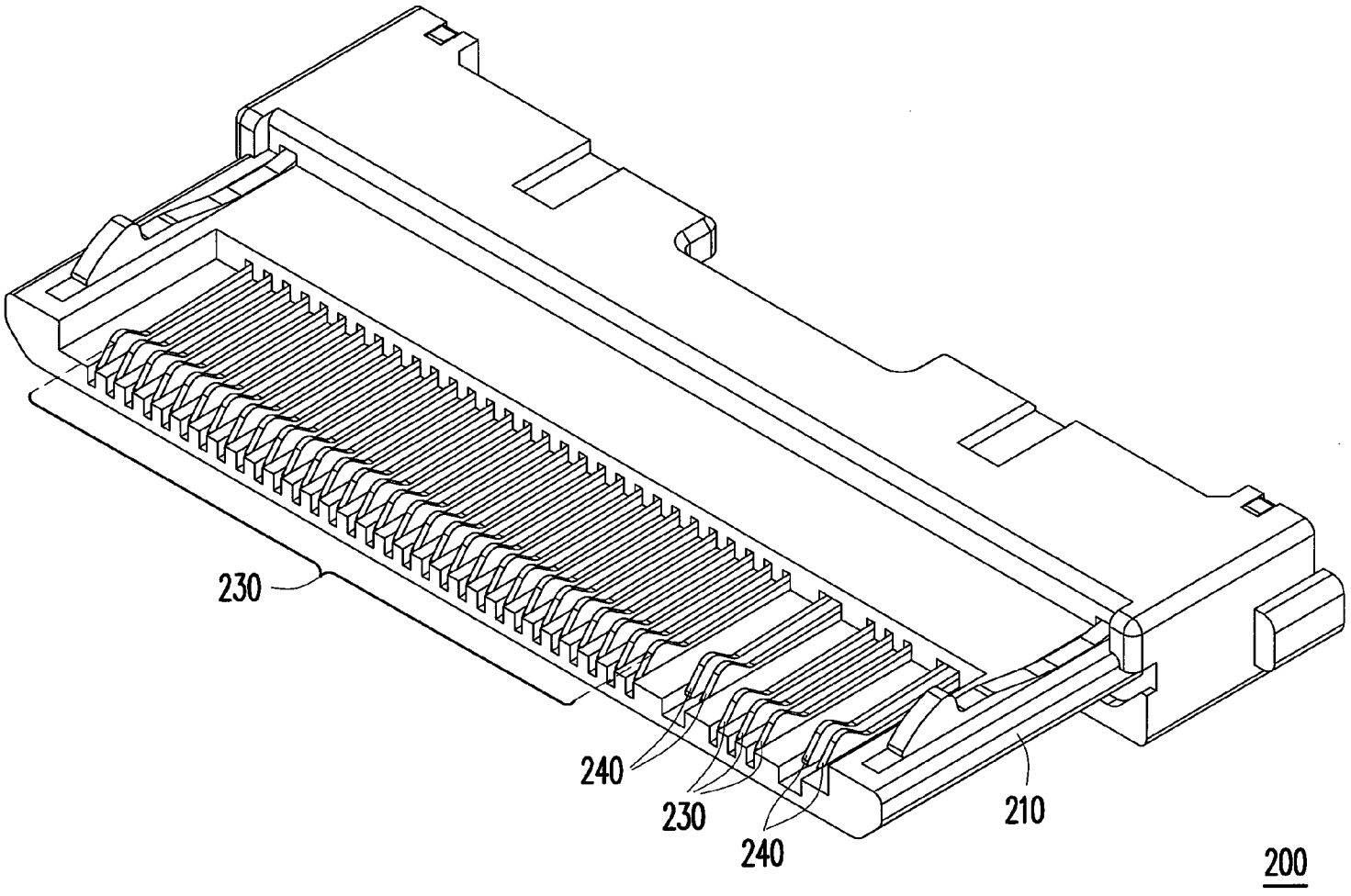

FIG. 3A and FIG. 3B are schematic drawings respectively showing a whole structure and a partial structure of the plug connector 200 of FIG. 1 in another view angle. Referring to FIG. 1 through FIG. 3, the plug connector 200 is suitable for being connected to the socket connector 100. In the present embodiment, the plug connector 200 has an insertion end 210 which is in a profile matched with the slot 112 of the socket connector 100. When the plug connector 200 is connected to the socket connector 100, the insertion end 210 enters the slot 112 and is assembled to the base 110. In addition, the insertion end 210 has an opening 212 for accommodating the tongue 120 of the socket connector 100 when the plug connector 200 is connected to the socket connector 100. Plural first leads 230 and plural second leads 240 are disposed in the opening 212. The first leads 230 are disposed in corresponding to the first terminals 130 and adapted to be contact with the corresponding first terminals 130 when the tongue 120 of the socket connector 100 is inserted into the opening 212 of the insertion end 210. The second leads 240 are disposed in corresponding to the second terminals 140 and adapted to be contact with the corresponding second terminals 140 when the tongue 120 of the socket connector 100 is inserted into the opening 212 of the insertion end 210.

In the present embodiment, one second terminal 140 is corresponding to a pair of second leads 240, i.e., two second leads 240 in identical functions is arranged to be contact with the same second terminals 140 for carrying a large current. Obviously, in other embodiments, the amount of the second leads 240 being corresponding to each of the second terminals 140 may be varied according to actual requirements. Additionally, the amount of the terminals of the socket connector 100 is not limited in the present embodiment. Referring to the socket connector 100 of FIG. 2A and FIG. 2B, the total amount of the first terminals 130 and the second terminals 140 is 35, which facilitates the integration of multiple interfaces, such as High-Definition Multimedia Interface (HDMI), audio interface, universal serial bus (USB) interface, charging interface, and so on, wherein the amount of the second terminals 140 is two, to serve as power terminals. The universal serial bus (USB) interface may further comprises Mini-USB interface or Micro-USB interface.

Furthermore, referring to FIG. 2A, the present embodiment may further be provided with a first enhancing member 150 mounted on the first tongue 120 to increase the structural strength thereof, wherein a stiffness of the first enhancing member 150 is greater than a stiffness of the first tongue 120, to improve for example tensile strength, bending strength or shear strength, i.e. the ability of the first tongue 120 in resisting damage caused by external impact or in a long time use. More specifically, the first enhancing member 150 of the present embodiment includes two first enhancing plates 152 attached on the second surface 124 of the first tongue 120. And, in consideration to the weak structure at two side edges of the first tongue 120, the first enhancing plates 152 can be disposed adjacent to the two side edges to enhance the structural strength thereof. Therefore, reliability and lifetime of the socket connector can be increased.

Additionally, in order to keep a smooth appearance of the first tongue 120 to be inserted into the opening 212 of the insertion end 210, the first tongue 120 can be formed with two depressed portions 124*a* on the second surface 124 for accommodating the two first enhancing plates 152. Thus, the two first enhancing plates 152 can be embedded into the first tongue 120 through the corresponding depressed portions 124*a*, and a top of each of the two first enhancing plates 152 is aligned with a top of the first tongue 120.

However, the present application does not limit the profile or location of the first enhancing member 150. For example, in other embodiments, the first enhancing member 150 can be embedded into the first tongue 120 deeply such that the first tongue 120 encapsulates the first enhancing member 150, or the first enhancing member 150 may be extended to cover the whole second surface 124.

Figure 4:
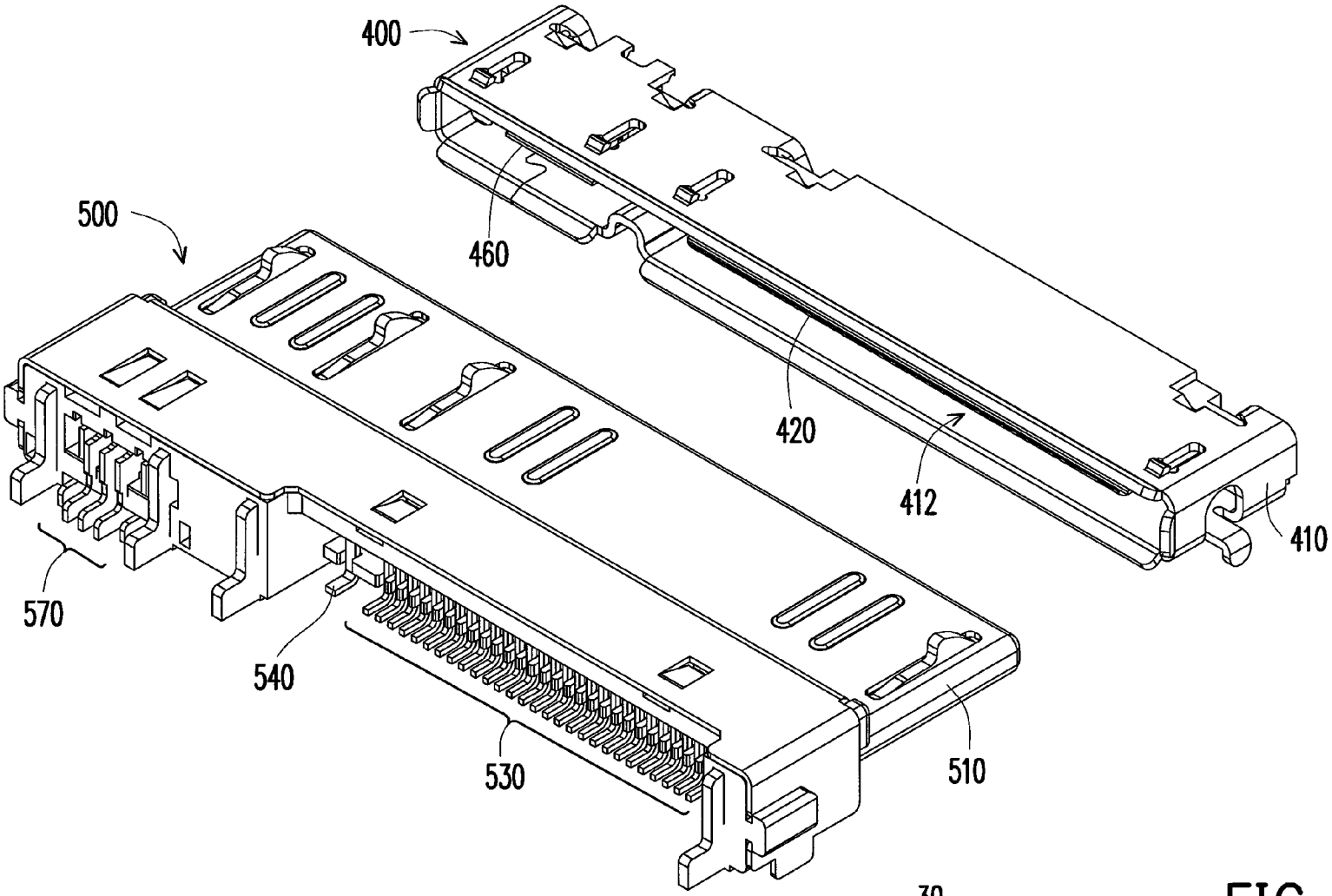
FIG. 4 is an exploded view of a connector assembly according to another embodiment of the present application.

FIG. 4 is an exploded view of a connector assembly according to another embodiment of the present application. The connector assembly 30 of the present embodiment includes a socket connector 400 and a plug connector 500 matched with each other. In compared with the connector assembly 10 of the above-mentioned embodiment, the connector assembly 30 of the present embodiment includes two independent connecting interfaces. In specific, the socket connector 400 has a first tongue 420 and a second tongue 460 both located in the slot 412 of the base 410 and connected to the base 410.

Figure 5A:
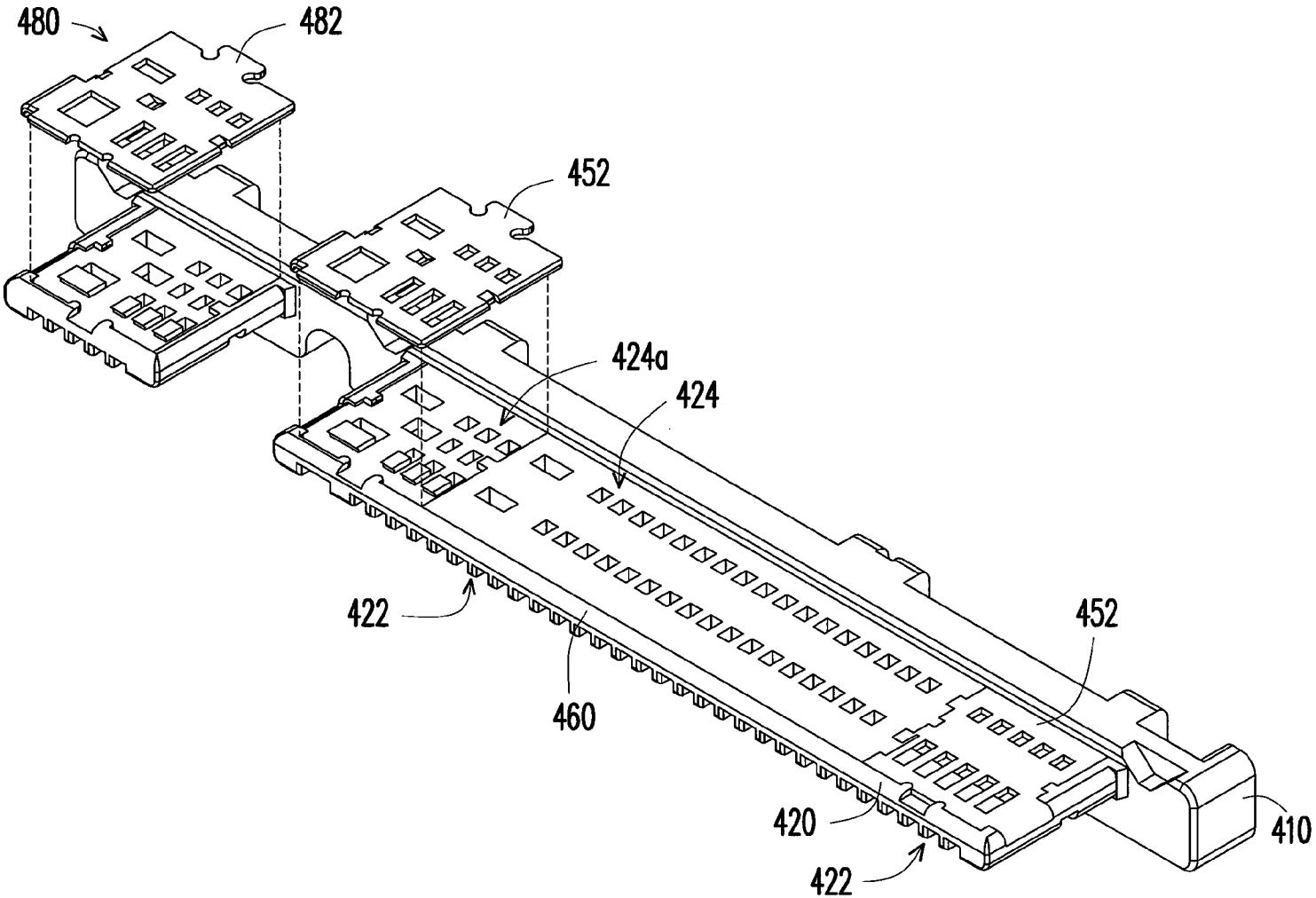
FIG. 5A and FIG. 5B are schematic drawings showing a partial structure of the socket connector of FIG. 4 in different view angles.
Figure 5B:
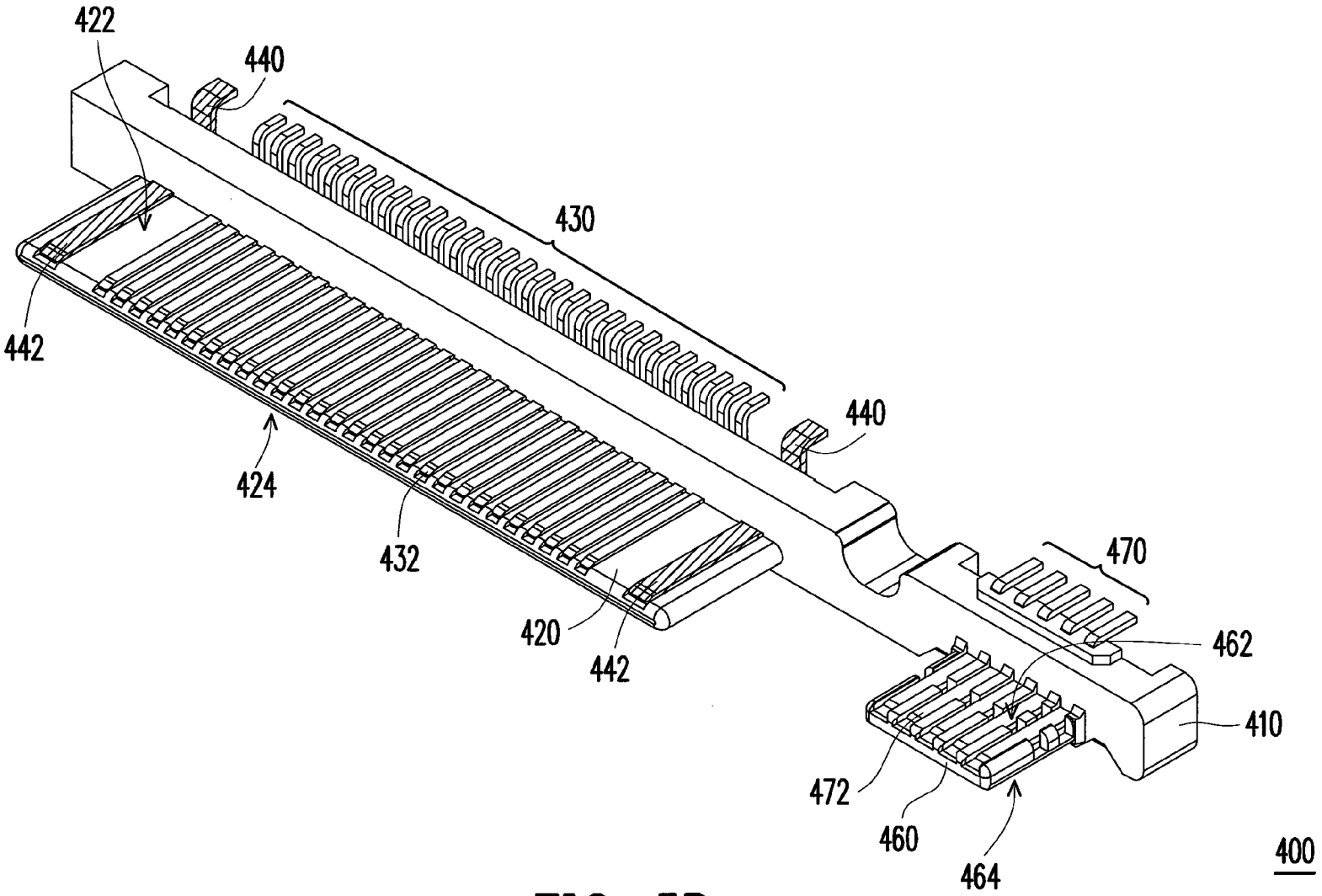
Figure 6A:
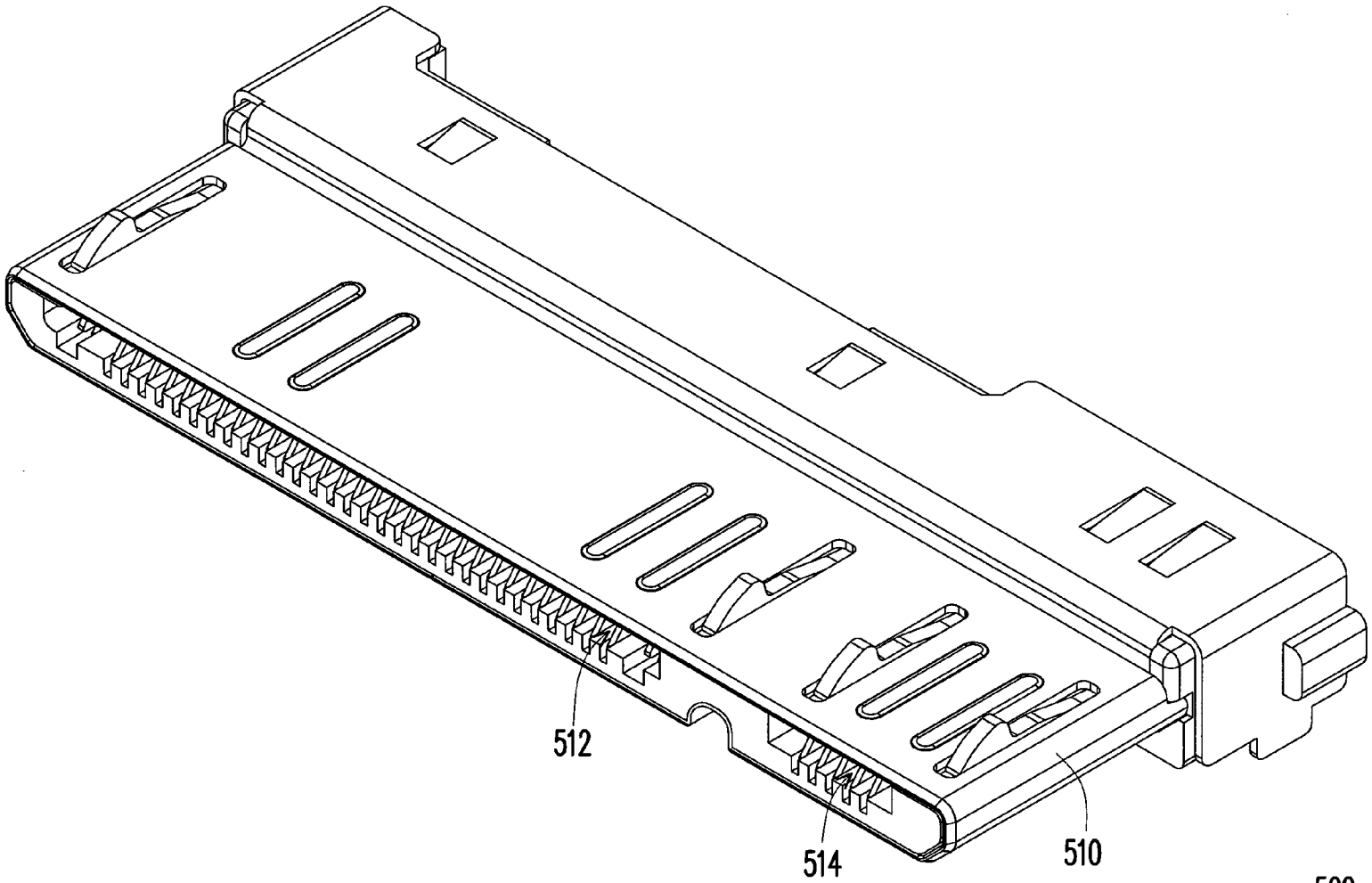
FIG. 6A and FIG. 6B are schematic drawings respectively showing a whole structure and a partial structure of the plug connector of FIG. 4 in another view angle.
Figure 6B:
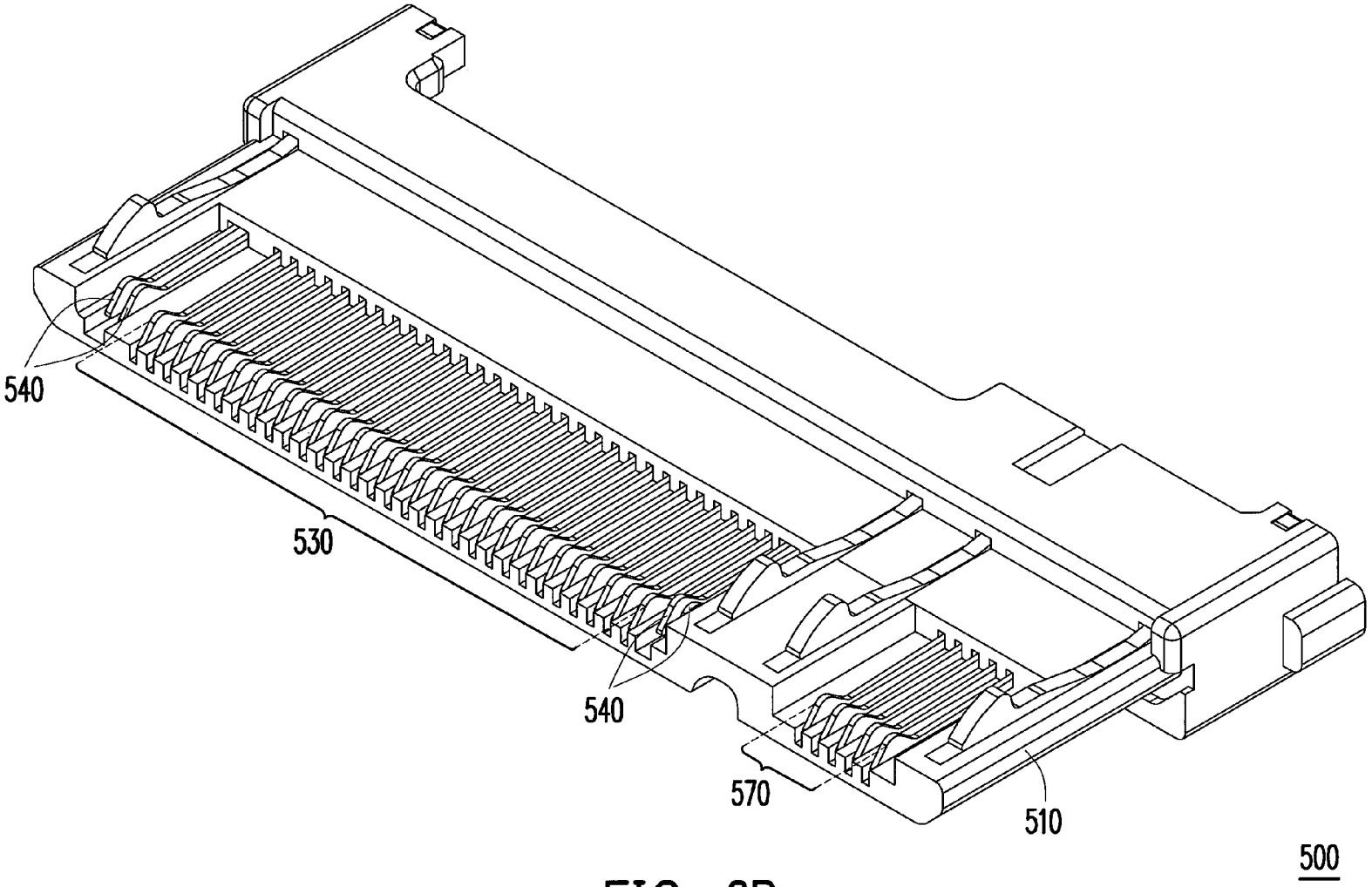

FIG. 5A and FIG. 5B are schematic drawings showing a partial structure of the socket connector 400 of FIG. 4 in different view angles. Referring to FIGS. 4, 5A and 5B, the first tongue 420 has a first surface 422 and a second surface 424 opposite to the first surface 422. First terminals 430 and second terminals 440 pass through the base 410, wherein each of the first terminals 430 and each of the second terminals 440 respectively have a first contact portion 432 and a second contact portion 442 both mounted on the first surface 422 of the first tongue 420. In addition, the second substrate 460 has a third surface 462 and a fourth surface 464 opposite to the third surface 462. Third terminals 470 pass through the base 410, wherein each of the third terminals 470 has a third contact portion 472 mounted on the third surface 462 of the second tongue 460. In the present embodiment, a cross-section of each of the second terminals 440 is greater than a cross-section of each of the first terminals 430 or each of the third terminals 470. The socket connector 400 of the present embodiment is provided with second terminals 440 having large cross-sections to meet the requirements of transmitting large current or quick charge. FIG. 6A and FIG. 6B are schematic drawings respectively showing a whole structure and a partial structure of the plug connector 500 of FIG. 4 in another view angle. Referring to FIG. 4 through FIG. 6, the plug connector 500 is suitable for being connected to the socket connector 400. In the present embodiment, the plug connector 500 has an insertion end 510 which is in a profile matched with the slot 412 of the socket connector 400. When the plug connector 500 is connected to the socket connector 400, the insertion end 510 enters the slot 412 and is assembled to the base 410. In addition, the insertion end 510 has a first opening 512 and a second opening 514 for accommodating the first tongue 420 and the second tongue 460 of the socket connector 400 when the plug connector 500 is connected to the socket connector 400. Plural first leads 530 and plural second leads 540 are disposed in the first opening 512, while plural third leads 570 are disposed in the second opening 514. The first leads 530 are disposed in corresponding to the first terminals 430 and adapted to be contact with the corresponding first terminals 430 when the first tongue 420 of the socket connector 400 is inserted into the first opening 512 of the insertion end 510. The second leads 540 are disposed in corresponding to the second terminals 440 and adapted to be contact with the corresponding second terminals 440 when the first tongue 420 of the socket connector 400 is inserted into the first opening 512 of the insertion end 510. The third leads 570 are disposed in corresponding to the third terminals 470 and adapted to be contact with the corresponding third terminals 470 when the second tongue 460 of the socket connector 400 is inserted into the second opening 514 of the insertion end 510.

In the present embodiment, one second terminal 440 is corresponding to a pair of second leads 540, i.e., two second leads 540 in identical functions is arranged to be contact with the same second terminals 440 for carrying a large current. Obviously, in other embodiments, the amount of the second leads 540 being corresponding to each of the second terminals 440 may be varied according to actual requirements. Additionally, the amount of the terminals of the socket connector 400 is not limited in the present embodiment. Referring to the socket connector 400 in FIG. 5A and FIG. 5B, the third terminals 470 independently disposed on the second tongue 460 may serve as a Micro-USB interface and are provided in the amount of five. In other embodiments, the third terminals 470 independently disposed on the second tongue 460 may further serve as a Mini-USB interface or a USB interface, alternatively. Furthermore, the total amount of the first terminals 430 and the second terminals 440 on the first tongue 420 may be 30, which is capable of integrating various interfaces, such as High-Definition Multimedia Interface (HDMI), audio interface, universal serial bus (USB) interface, charging interface, and so on, wherein the amount of the second terminals 440 is two, to serve as power terminals.

Furthermore, referring to FIG. 5A, the present embodiment may further be provided with a first enhancing member 450 mounted on the first tongue 420 and a second enhancing member 480 mounted on the second tongue 460 to increase the structural strength of the first tongue 420 and the second tongue 460. A stiffness of the first enhancing member 450 and a stiffness of the second enhancing member 480 are greater than a stiffness of the first tongue 420 and a stiffness of the second tongue 460, respectively, to improve for example tensile strength, bending strength or shear strength, i.e. the ability of the first tongue 420 and the second tongue 460 in resisting damage caused by external impact or in a long time use.

More specifically, the first enhancing member 450 of the present embodiment includes two first enhancing plates 452 attached on the second surface 424 of the first tongue 420. And, in consideration to the weak structure at two side edges of the first tongue 420, the first enhancing plates 452 can be disposed adjacent to the two side edges to enhance the structural strength thereof. In addition, the second enhancing member 480 of the present embodiment includes a second enhancing plates 482 attached on the fourth surface 464 of the second tongue 460. Since the second tongue 460 is in a smaller size as compared with the first tongue 420, the second enhancing plate 482 approximately covers the whole fourth surface 464 of the second tongue 460. Therefore, reliability and lifetime of the socket connector can be increased.

Additionally, in order to keep a smooth appearance of the first tongue 420 and the second tongue 460 to be respectively inserted into the first opening 512 and the second opening 514 of the insertion end 510, the first tongue 420 can be formed with two depressed portions 424*a* on the second surface 424 for accommodating the two first enhancing plates 452, and the second tongue 460 can be formed with a depressed portion 464*a* on the fourth surface 464 for accommodating the second enhancing plate 482. Thus, the two first enhancing plates 452 can be embedded into the first tongue 420 through the corresponding depressed portions 424*a*, and a top of each of the two first enhancing plates 452 is aligned with a top of the first tongue 420. And, the second enhancing plate 482 can be embedded into the second tongue 460 through the corresponding depressed portions 464*a*, and a top of the second enhancing plate 482 is aligned with a top of the second tongue 460.

However, the present application does not limit the profile or location of the first enhancing member 450 and the second enhancing member 480. For example, in other embodiments, the first enhancing member 450 and the second enhancing member 480 can be respectively embedded into the first tongue 420 and the second tongue 460 deeply such that the first tongue 420 and the second tongue 460 can respectively encapsulate the first enhancing member 450 and the second enhancing member 480, or the first enhancing member 450 may be extended to cover the whole second surface 424.

Figure 7:
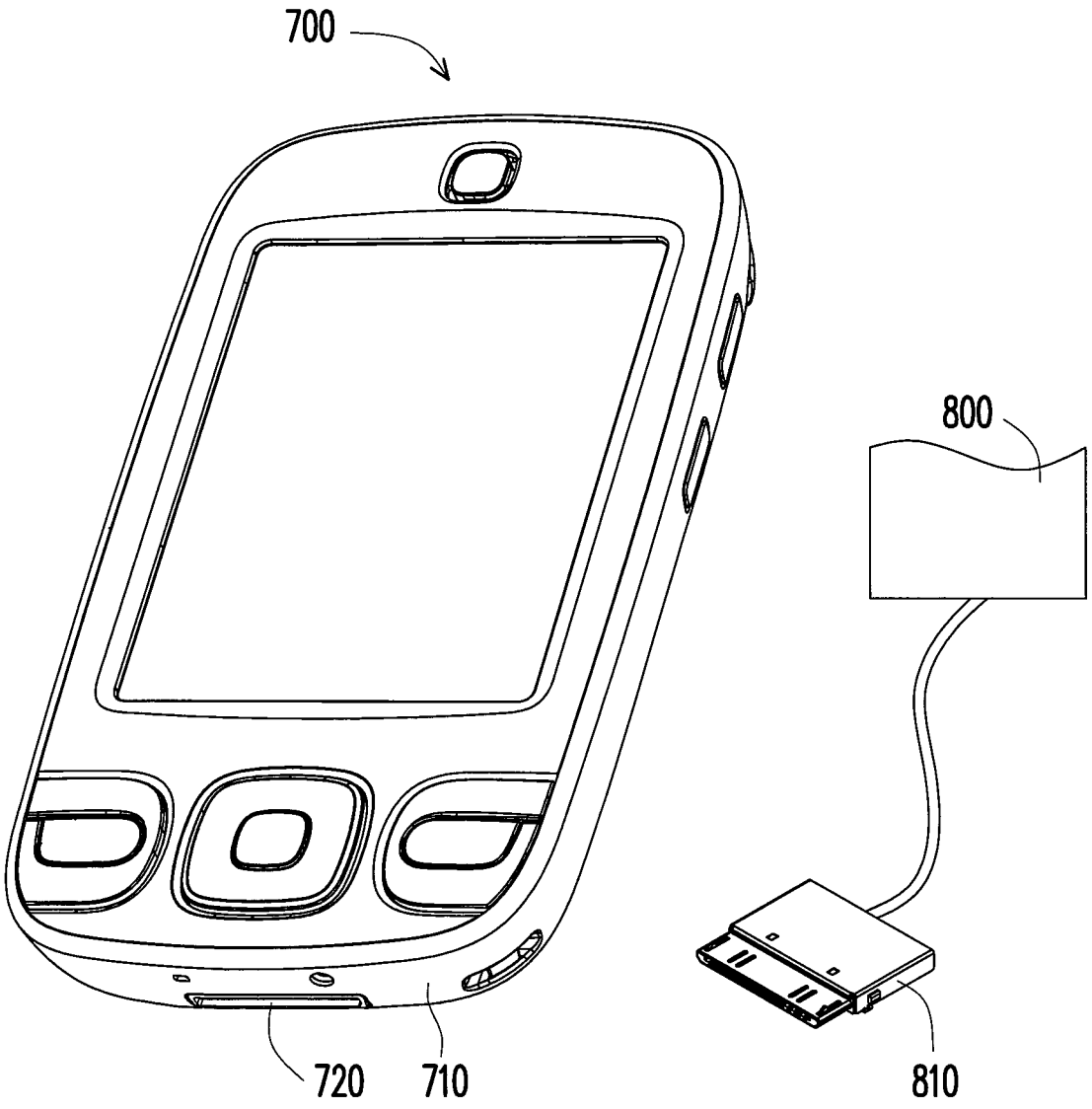
FIG. 7 illustrates a handheld electronic device adopting a socket connector of the present application.

FIG. 7 illustrates a handheld electronic device adopting a socket connector of the present application. As shown in FIG. 7, a handheld electronic device 700, such as a smart phone, comprising a main body 710 and a socket connector 720 is provided. The main body 710 may be provided with common components such as display panel 712 or operation interface 714 thereon. The socket connector 720 on the main body 710 can be coupled to a plug connector 810, thereby the external device 800, such as a earphone, a multimedia display, or a battery charger, having the plug connector 810, can be connected to the main body 710 through the socket connector 720. The socket connector 720 can be the socket connector 100 or the socket connector 400 illustrated in the above embodiments, while the plug connector 810 can be the plug connector 200 or the plug connector 500 matched with the socket connector 100 or the socket connector 400 in the above embodiments. The socket connector 720 is capable of integrating multiple connecting interfaces, such as High-Definition Multimedia Interface (HDMI), audio interface, universal serial bus (USB) interface, charging interface, and so on, for saving the manufacturing cost, and the size and the weight of the handheld electronic device can be reduced.

In summary, the present application provides a socket connector having high current carrying capacity by enlarging cross-section of particular terminals, to meet the requirement of transmitting large current or quick charge. In addition, since the socket connector has high current carrying capacity, diverse applications, such as integrating multifunctional interfaces of video-audio transmission, data transmission and quick charge, can be accomplished. Furthermore, the present application can further be provided with enforcing members disposed on the tongue of the socket connector to enhance structural strength of the tongue and prevent the tongue from being damaged by external impact or in a long time use. Therefore, reliability and lifetime of the socket connector can be increased.

Although the application has been described with reference to the embodiments thereof, it will be apparent to one of the ordinary skills in the art that modifications to the described embodiments may be made without departing from the spirit of the application. Accordingly, the scope of the application will be defined by the attached claims not by the above detailed description.

What is claimed is:

1. A socket connector suitable for being connected to a plug connector, the socket connector comprising:

a base provided with a slot for accommodating the plug connector being assembled thereto;

a first tongue connected to the base and located in the slot, the first tongue having a first surface and a second surface opposite to the first surface;

a first enhancing member integrated with the first tongue, wherein the stiffness of the first enhancing member is greater than a stiffness of the first tongue;

a plurality of first terminals passing through the base, wherein each of the plurality of first terminals has a first contact portion mounted on the first surface of the first tongue; and a plurality of second terminals passing through the base, wherein each of the plurality of second terminals has a second contact portion mounted on the first surface of the first tongue, and a cross-section of each of the plurality of second terminals is greater than a cross-section of each of the plurality of first terminals.

2. The socket connector as claimed in claim 1, wherein the first enhancing member comprises two first enhancing plates adjacent to two side edges of the first tongue, respectively.

3. The socket connector as claimed in claim 2, wherein the two first enhancing plates are attached to the second surface of the first tongue.

4. The socket connector as claimed in claim 3, wherein the two first enhancing plates are embedded into the first tongue, and a top of each of the two first enhancing plates is aligned with a top of the first tongue.

5. The socket connector as claimed in claim 1, further comprising:

a second tongue connected to the base and located in the slot, the second tongue having a third surface and a fourth surface opposite to the third surface; and a plurality of third terminals passing through the base, wherein each of the plurality of third terminals has a third contact portion mounted on the third surface of the second tongue, and a cross-section of each of the plurality of second terminals is greater than a cross-section of each of the plurality of third terminals.

6. The socket connector as claimed in claim 5, further comprising a second enhancing member integrated with the second tongue, wherein the stiffness of the second enhancing member is greater than a stiffness of the second tongue.

7. The socket connector as claimed in claim 6, wherein the second enhancing member comprises a second enhancing plate.

8. The socket connector as claimed in claim 7, wherein the second enhancing plate is attached to the fourth surface of the second tongue.

9. The socket connector as claimed in claim 8, wherein the second enhancing plate is embedded into the second tongue, and a top of the second enhancing plate is aligned with a top of the second tongue.

10. The socket connector as claimed in claim 5, wherein the total amount of the first terminals and the second terminals is 30, and the amount of the third terminals is 5.

11. The socket connector as claimed in claim 1, wherein the total amount of the first terminals and the second terminals is 35.

12. The socket connector as claimed in claim 1, wherein the second terminals are power terminals.

13. A handheld electronic device, comprising:

a main body; and a socket connector as claimed in claim 1, wherein the socket connector is disposed on the main body for a plug connector to be connected to the main body through the socket connector.

14. A plug connector suitable for being connected to the socket connector as claimed in claim 1, the plug connector comprising:

a plurality of first leads, disposed in corresponding to the plurality of first terminals and adapted to be contact with the plurality of first terminals when the plug connector is connected to the socket connector; and a plurality of second leads, disposed in corresponding to the plurality of second terminals and adapted to be contact with the plurality of second terminals when the plug connector is connected to the socket connector, wherein each of the plurality of second terminals is in contact with at least two of the plurality of second leads.

15. A connector assembly, comprising:

a socket connector, comprising:

a base provided with a slot;

a first tongue connected to the base and located in the slot, the first tongue having a first surface and a second surface opposite to the first surface;

a first enhancing member integrated with the first tongue, wherein the stiffness of the first enhancing member is greater than a stiffness of the first tongue;

a plurality of first terminals passing through the base, wherein each of the plurality of first terminals has a first contact portion mounted on the first surface of the first tongue; and a plurality of second terminals passing through the base, wherein each of the plurality of second terminals has a second contact portion mounted on the first surface of the first tongue, and a cross-section of each of the plurality of second terminals is greater than a cross-section of each of the plurality of first terminals; and a plug connector suitable for being connected with the socket connector and being assembled to the base through the slot, the plug connector comprising:

a plurality of first leads, disposed in corresponding to the plurality of first terminals and adapted to be contact with the plurality of first terminals when the plug connector is connected to the socket connector; and a plurality of second leads, disposed in corresponding to the plurality of second terminals and adapted to be contact with the plurality of second terminals when the plug connector is connected to the socket connector, wherein each of the plurality of second terminals is contact with at least two of the plurality of second leads.

* * * * *